United States Patent [19]

Quinn, Jr.

[11] Patent Number: 4,786,193

[45] Date of Patent: Nov. 22, 1988

[54] PRESSURE ROLLER ASSEMBLY

[75] Inventor: Richard E. Quinn, Jr., Pepperell, Mass.

[73] Assignee: Wang Laboratories, Lowell, Mass.

[21] Appl. No.: 613,677

[22] Filed: May 24, 1984

[51] Int. Cl.[4] ..... B41J 13/048; B41J 13/076

[52] U.S. Cl. ..... 400/636.3; 400/637.6

[58] Field of Search ..... 400/617, 636.3, 636, 400/637.6, 637.5, 638; 271/274, 275; 226/24, 76, 82, 83, 81, 87

[56] References Cited

U.S. PATENT DOCUMENTS

| | | | |
|---|---|---|---|
| 932,307 | 8/1909 | Myers | 400/638 |
| 979,000 | 12/1910 | Gibbs | 400/637.5 |
| 1,023,172 | 4/1912 | Purdy | 400/638 |
| 1,478,380 | 12/1923 | Crawley | 400/637.5 |
| 3,490,670 | 1/1970 | Carrell | 226/187 |
| 3,561,660 | 2/1971 | Nicol | 226/187 |
| 3,756,589 | 9/1973 | Carbine | 271/274 |
| 4,364,683 | 12/1982 | Shakib | 400/637.6 |

FOREIGN PATENT DOCUMENTS

| | | | |
|---|---|---|---|
| 188043 | 3/1937 | Switzerland | 400/637.6 |

OTHER PUBLICATIONS

Lloyd; IBM Tech. Disc. Bull., vol. 23, No. 2; Jul. 1980, pp. 678 and 679.

*Primary Examiner*—Clifford D. Crowder
*Attorney, Agent, or Firm*—Michael H. Shanahan; Kenneth L. Milik

[57] ABSTRACT

A truck assembly unit has two identical parts which lock together capturing two rollers. The truck assembly unit is supported on a cylindrical portion of a support bar so that it can rotate through a limited range, the range being limited by a ridge running along the bar. The bar is affixed eccentrically on journals captured in the frame of a typing machine so that rotation of the bar moves the supported truck assembly towards and away from a platen. Arms supporting the rollers provide flexure to bias the rollers against the platen.

4 Claims, 2 Drawing Sheets

PRESSURE ROLLER ASSEMBLY

BACKGROUND OF THE INVENTION

This invention relates to mechanisms for feeding web such as paper through a typing machine or the like.

Although many designs are known for mechanisms used in typing machines to feed the paper, there is a continuing need for designs having lower production costs.

BRIEF SUMMARY OF THE INVENTION

The invention features a truck assembly unit comprising two identical roller support members and two identical rollers, each roller support member having a base portion for receiving support for the truck assembly unit, two roller support arms of equal length affixed to the base portion, and a roller journal supported on one of the arms, the roller journal carrying a roller, the roller support member having a self complementary locking mechanism whereby two of the identical support members may be locked together capturing two rollers on the roller journals.

The invention may additionally feature roller support arms that flex elasticly to provide a biasing force pressing said rollers against a platen a support bar having a longitudinally uniform cross-section bounded in part by a circular arc and in part by a protrusion extending to a greater radius than that of the arc; a base portion of the truck assembly having an inwardly facing cylindrical surface complementary to and engaging the arcuate surface of the support bar; the inwardly directed surface extending through an arc less than the arc of the support bar surface to permit limited rotation of the truck assembly around the axis of said bar; and eccentric support journals for the bar so that rotation of the journals in their bearings moves the bar towards and away from a platen roll.

The invention provides a pressure roller assembly with particularly low manufacturing cost, being made of a small number of simple parts which are assembled with minimum labor.

DETAILED DESCRIPTION OF THE INVENTION

Figure 1:
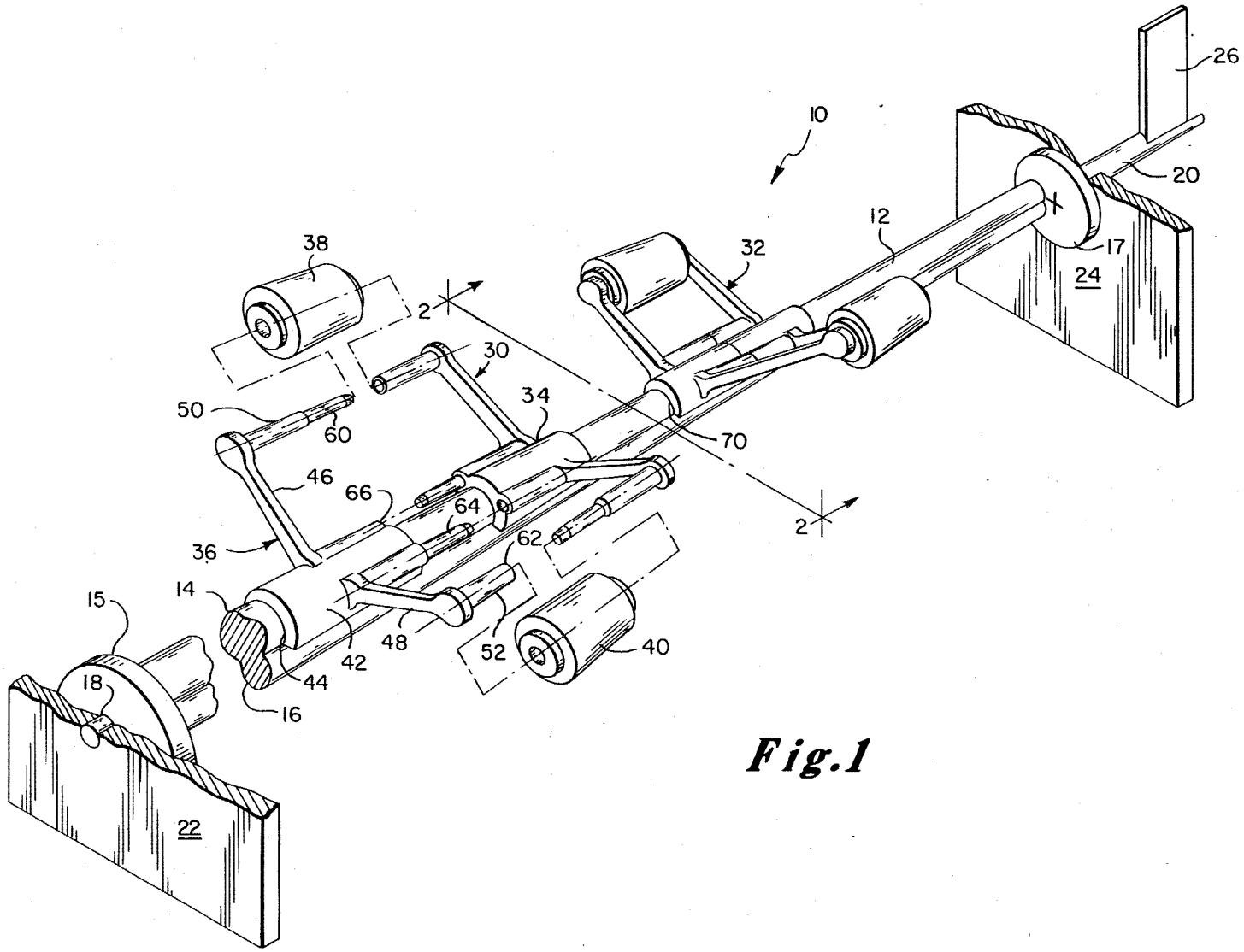
FIG. 1 shows in perspective view with some parts broken away, a pressure roller assembly with several truck assembly units, both according to the invention.

Referring to the Figures, pressure roller assembly 10 includes support bar 12 which has a uniform cross-section bounded in part by circular arc 14 and in part by protrusion 16 extending to a greater radius than that of arc 14. The surface of bar 12 thus has a circular cylinder portion and a rib portion extending therefrom. Bar 12 is affixed eccentrically through eccentric section 15, 17 in journals 18 and 20 which are captured in and supported by portions 22 and 24 of the frame of a printing machine. Lever 26 attached to bar 12 permits an operator to rotate the bar between stops (not shown) affixed to frame portion 24. Bar 12 with affixed eccentic sections

15 and 17 and journals 18 and 20 may advantageously be moulded as an integral piece.

First truck assembly unit 30 is shown disassembled and positioed on bar 12 in FIG. 1, while second truck assembly unit 32 is shown as finally assembled and positioned on the bar. It will be understood that the truck assembly units will be assembled apart from the support bar and positioned on the bar only after assembly. Truck assembly unit 30 includes two identical roller support members 34 and 36 and two identical rollers 38 and 40. Support member 36 has a base portion 42 with an inwardly facing cylindrically shaped surface 44 which is complmentary to the circular cross-section portion 14 of bar 12 but extending through an arc less than that of bar 12. Roller support member 36 has two roller support arms 46, 48 of equal length affixed to base portion 42. Roller support arms 46, 48 carry roller journals 50 and 52. Roller support arms 46, 47 are sized with respect to their materials of construction so as to provide flexing when the roller journals are pressed. Roller support member 36 has a self complementary locking system which includes peg 60 and complementary hole 62, and peg 64 and complementary hole 66. As shown in FIG. 1, two support members such as 36 and 34 can be locked together using the complementary pegs and holes with rollers 36 and 40 captured on roller journals 50 and 52 to form a completed truck assembly unit such as 32. Completed truck assembly unit 32 rests on bar 12 with its inwardly facing cylindrical surface 70 engaging the cylindrical surface of bar 12 corresponding to the circular portion of the bar cross-section, and because the engaging surface of truck assembly unit 32 extends through a lesser arc than the cylindrical surface of bar 12, the truck assembly unit can be rotated through a limited angle on the bar.

The assembly operation is very simple requiring little labor time: A pair of identical roller support members are snapped together while capturing a pair of identical rollers on the roller journals, to form a truck assembly unit; a support bar is captured between the frame portions of the printing machine as it is put together; one or more truck assembly units are placed on the bar; and the platen is emplaced on the machine.

Figure 3:
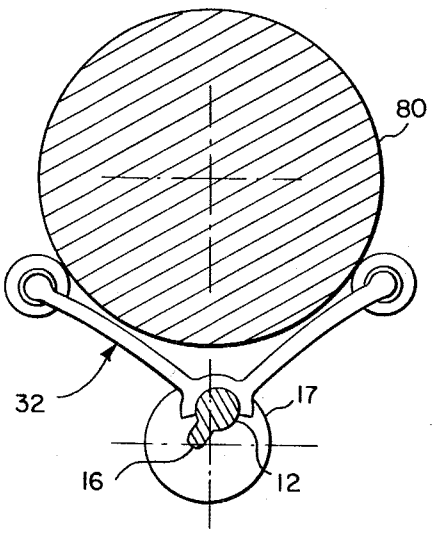
FIG. 3 shows the same view as FIG. 2 except the truck assembly units are engaged with the platen.
Figure 2:
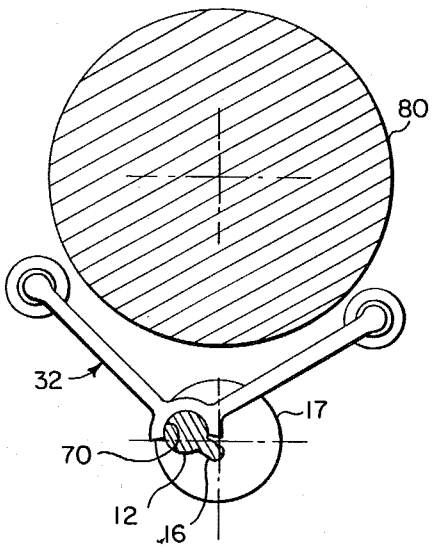
FIG. 2 shows a cross-sectional view of the roller assembly of FIG. 1 with a platen roll of a typing machine. In this Figure the truck assembly units are disengaged from the platen.

The operation of the pressure roller assembly is illustrated particularly in FIGS. 2 and 3. With the bar 26 rotated backward, bar 12 is moved away from the platen 80 because of the eccentric action and separates the rollers from the platen as shown in FIG. 2. When lever 26 is pulled forward, the bar is raised pressing the rollers against the platen, while the flexing of the roller support arms provides a biasing force urging the rollers uniformly into contact with the platen irrespectively of any small misalignment of the mechanism.

The low cost of the described mechanism will be readily recognized. Only three part types are required: bar, roller support member, and roller. The whole mechanism is readily and quickly put together without use of any tools.

Numerous variations of design within the scope of the invention will be evident to those skilled in the art, including variations in the positioning and details of the locking device and in the allocation of the roller journals between the two roller support arms.

What is claimed is:

1. In a mechanism for feeding web such as paper in a typing machine, a truck assembly unit comprising two identical roller support members and two identical rollers, said roller support members including base means for supporting said truck assembly unit on a bar structure spanning a typing machine, and spring arms supporting said rollers on the base means and, when installed in a typing machine, pressing both the rollers against a platen of a typing machine, the two roller support members including journal means for capturing said rollers between the support members and supporting the rollers so captured, the roller support members including self complimentary snap locking means for permanently locking two of them together with rollers captured therebetween to provide a permanently assembled unit for installation as a whole in a typing machine.

2. A truck assembly unit as claimed in claim 1, wherein said roller support arms flex elastically permitting motion of said rollers in a direction tangential to said base portion to provide a biasing force pressing said rollers against a platen.

3. A pressure roller assembly for friction feed of a web in a typing machine or the like using a cylindrical platen, including at least one truck assembly unit as claimed in claims 1 or 2, and a support bar, said support bar having a longitudinally uniform cross-section bounded in part by a circular arc and in part by a protrusion extending to a greater radius than that of said arc, the base portion of said truck assembly unit having an inwardly facing cylindrical surface complementary to and engaging an arcuate surface of said support bar corresponding to the circular arc portion of said bar cross-section, said inwardly directed surface extending through an arc small enough to permit assembling of said truck assembly unit to said support bar with radial relative motion and limited rotation of the truck assembly unit around the axis of said bar after it has been assembled to said bar.

4. A pressure roller assembly as claimed in claim 3, said support bar being attached eccentrically to and supported by two journals, so that rotation of the journals in their bearings moves the bar towards and away from the platen roll.

* * * * *